US011493003B2

(12) United States Patent
Fernand et al.

(10) Patent No.: US 11,493,003 B2
(45) Date of Patent: Nov. 8, 2022

(54) ASSEMBLY AND MOTOR VEHICLE

(71) Applicant: Faurecia Emissions Control Technologies, Germany GmbH, Augsburg (DE)

(72) Inventors: Francois Fernand, Augsburg (DE); Valentin Sage Aubriot, Augsburg (DE)

(73) Assignee: Faurecia Emissions Control Technologies, Germany GmbH

( * ) Notice: Subject to any disclaimer, the term of this patent is extended or adjusted under 35 U.S.C. 154(b) by 0 days.

(21) Appl. No.: 17/551,269

(22) Filed: Dec. 15, 2021

(65) Prior Publication Data

US 2022/0195967 A1 Jun. 23, 2022

(30) Foreign Application Priority Data

Dec. 17, 2020 (DE) ..... 10 2020 133 984.4

(51) Int. Cl.

| | |
|---|---|
| ***F02M 26/12*** | (2016.01) |
| ***F02M 26/28*** | (2016.01) |
| ***F01N 5/02*** | (2006.01) |
| ***F02M 26/52*** | (2016.01) |
| ***F02M 26/70*** | (2016.01) |

(52) U.S. Cl.

CPC ..... *F02M 26/12* (2016.02); *F01N 5/02* (2013.01); *F02M 26/28* (2016.02); *F02M 26/52* (2016.02); *F02M 26/70* (2016.02)

(58) Field of Classification Search

CPC ..... F02M 26/12; F02M 26/28; F02M 26/52; F02M 26/70; F02M 26/16; F02M 26/58; F02M 26/72; F02M 26/73; F02M 26/74; F01N 5/02

See application file for complete search history.

(56) References Cited

U.S. PATENT DOCUMENTS 5,970,960 A * 10/1999 Azuma ..... F02M 35/10222 123/568.17
6,237,547 B1 * 5/2001 Ishiyama ..... F02M 26/30 123/41.31
6,513,507 B2 * 2/2003 Balekai ..... F02M 35/10222 123/568.17

(Continued)

FOREIGN PATENT DOCUMENTS

DE 102004045021 A1 4/2006
DE 102005041149 A1 * 2/2007 ..... F02M 26/11

(Continued)

OTHER PUBLICATIONS

Photo vacuum actuator; Wachsmuth, Thomas: "Efficiency from the turbocharger—the improved vacuum actuator". Tunigblog.eu, Jan. 9, 2020. URL: https://www.tuningblog.eu/kategorien/tuningwiki/druckdose-256653/attachment/unterdruckdosevakuumdose-turbodose/, retrieved on Nov. 11, 2021.

*Primary Examiner* — Hung Q Nguyen
(74) *Attorney, Agent, or Firm* — Carlson, Gaskey & Olds, P.C.

(57) ABSTRACT

An assembly for a motor vehicle has an exhaust gas-carrying pipe in which an adjustable element is arranged to control an exhaust gas flow through the exhaust gas-carrying pipe. An actuator is used to adjust the adjustable element. The actuator is connected in a planar manner to a vehicle structure via a connecting surface.

12 Claims, 3 Drawing Sheets

(56) References Cited

U.S. PATENT DOCUMENTS

| | | | | |
|---|---|---|---|---|
| 6,708,675 | B2 * | 3/2004 | Kato | F02B 47/08 123/568.23 |
| 6,789,532 | B2 * | 9/2004 | Kato | F02M 26/54 123/568.12 |
| 2003/0071524 | A1 * | 4/2003 | Doi | H02K 5/00 310/64 |
| 2007/0295483 | A1 | 12/2007 | Beck et al. | |
| 2009/0165449 | A1 * | 7/2009 | Christ | F02M 26/30 60/320 |
| 2012/0167862 | A1 * | 7/2012 | Nishimori | F16K 49/005 123/568.12 |
| 2017/0211722 | A1 * | 7/2017 | Hasegawa | F16K 27/02 |
| 2020/0080662 | A1 * | 3/2020 | Baasch | F16K 31/0613 |
| 2020/0116262 | A1 * | 4/2020 | De Matos | F16K 1/221 |

FOREIGN PATENT DOCUMENTS

| | | | |
|---|---|---|---|
| EP | 1746280 | A2 | 1/2007 |
| WO | 2007098854 | A1 | 9/2007 |

* cited by examiner

ASSEMBLY AND MOTOR VEHICLE

CROSS-REFERENCE TO RELATED APPLICATIONS

This application is a U.S. non-provisional application claiming the benefit of German Application No. 10 2020 133 984.4, filed on Dec. 17, 2020, which is incorporated herein by reference in its entirety.

TECHNICAL FIELD

The disclosure relates to an assembly for a motor vehicle, for example an assembly for a heat recovery system or an exhaust gas recirculation system of a motor vehicle, and to a motor vehicle comprising such an assembly.

BACKGROUND

Assemblies for heat recovery systems or exhaust gas recirculation systems typically comprise at least one adjustable element such as a flap to control a fluid flow. In particular with regard to the proportion of the volume flow passing through the heat exchanger, and the proportion passing through a bypass. An actuator is provided for adjusting the flap.

The actuator is usually screwed onto a separate support. Therefore, the mounting is relatively complex, and the support occupies installation space in addition to the actuator.

SUMMARY

The present disclosure provides an assembly for a heat recovery system or an exhaust gas recirculation system of a motor vehicle which can be manufactured in a particularly simple and cost-effective manner.

According to the disclosure, the assembly for a motor vehicle, in particular for a heat recovery system or an exhaust gas recirculation system of a motor vehicle, has an exhaust gas-carrying pipe in which an adjustable element is arranged to control an exhaust gas flow through the exhaust gas-carrying pipe. An actuator adjusts the adjustable element. The actuator is connected in a planar manner to a vehicle structure via a connecting surface.

Planar within the meaning of the disclosure means that the actuator is not fastened to a vehicle structure via individual screw points but is connected to the vehicle structure via an area of at least several square centimeters. However, this does not exclude the presence of one single screw connection for security purposes, for example.

Such a fastening of the actuator has the advantage that no, or significantly fewer, screw connections are necessary for fastening the actuator. Therefore, the mounting of the actuator is simplified and thus particular cost-effective. A further advantage is that no additional supports are required, as a result of which the assembly can be designed to be particularly compact such that the installation space required for the assembly is particularly small. Furthermore, the number of required components is low due to the omission of the support and the screw connections, which also has a beneficial effect on the manufacturing costs.

A fixed connection is in particular present between the connecting surface and the actuator.

According to one embodiment, a housing of the actuator is directly connected to the connecting surface by an intermaterial bond, in particular glued or soldered. To this end, a contact surface corresponding at least in sections to the connecting surface may be formed on the housing of the actuator. No further connectors are thus necessary for fastening the actuator. The assembly is particularly compact in that the actuator is directly connected to the connecting surface by an intermaterial bond, as there is no or only a very small distance between the actuator and the connecting surface. Alternatively, an intermediate plate may be provided, the actuator being fastened to the intermediate plate, in particular connected by an intermaterial bond, and the intermediate plate being connected to the connecting surface by an intermaterial bond, in particular glued or soldered. The intermediate plate may form an adapter to adapt the geometry of the actuator to the vehicle structure.

The connecting surface is, for example, formed in a continuous manner. It is thus particularly easy to create a connection between the actuator and the vehicle structure.

Recesses may be present within the connecting surface, no fixed connection between the actuator and the connecting surface being present in the region of the recesses. Such recesses may, for example, be located in regions in which a fastening is impossible or can only be achieved with great effort due to the geometric conditions.

It is also conceivable that two connecting surfaces separate from each other are present.

The connecting surface may be flat. This makes it particularly easy to create corresponding contact surfaces between the vehicle structure and the actuator.

The connecting surface may however also have a different geometry. The connecting surface may, for example, be curved or stepped or extend on different planes.

According to one embodiment, the assembly has a coolant jacket, a heat exchange being possible between the exhaust gas-carrying pipe and the coolant jacket, and the connecting surface being provided on the coolant jacket. This also contributes to a compact design of the assembly.

The actuator can be fastened directly to the coolant jacket in that the actuator is glued or soldered to the coolant jacket, without having to be screwed into the coolant jacket, such that no complex sealing is required.

The adjustable element is, for example, a flap, and the actuator is arranged to drive a rotatably mounted shank connected to the flap. An operative connection between the flap and the shank can thus be created in a particular simple manner.

The shank of the actuator extends through the coolant jacket, for example. This has the advantage that the actuator can be arranged at a distance from the adjustable element and the coolant jacket does not have to be interrupted over a large area, as a result of which a particularly large contact surface is present between the exhaust gas-carrying pipe and the coolant jacket. A particularly good heat transfer can thus take place. In addition, the shank and the actuator can be cooled.

A recess is in particular present in the connecting surface in the region in which the shank extends through the coolant jacket. This means that the shank breaks through the connecting surface and is surrounded by the connecting surface. The connecting surface, more precisely the adhesive or solder applied to the connecting surface can thus contribute to the sealing of the coolant jacket in the region in which the shank extends through the coolant jacket. Additional sealing measures can thus be omitted or simplified.

If an intermediate plate is provided, a corresponding recess may also be provided in the intermediate plate such that the shank extends through the intermediate plate.

Instead of a flap which can be adjusted by a rotatable shank, there may also be a slide which can be moved via the actuator to control the exhaust gas flow through the exhaust gas-carrying pipe.

The slide may also extend through the coolant jacket.

An exhaust gas recirculation component can branch off from the exhaust gas-carrying pipe downstream of the adjustable element. This additionally improves the efficiency of a heat recovery system.

According to the disclosure, a motor vehicle having a heat recovery system and/or an exhaust gas recirculation system comprising an assembly configured as described above is provided and that can be manufactured in simple and cost-effective manner.

BRIEF DESCRIPTION OF THE DRAWINGS

Further advantages and features of the disclosure will become apparent from the description below and from the accompanying drawings to which reference is made and in which.

DETAILED DESCRIPTION

Figure 1:
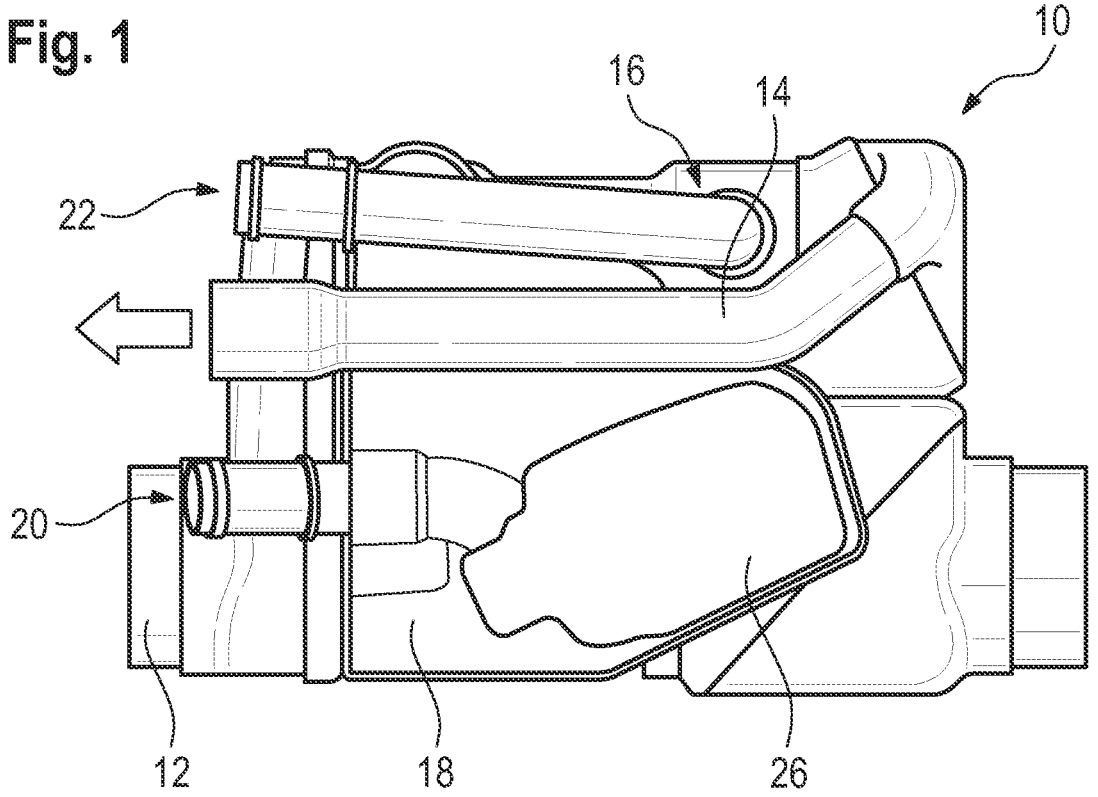
FIG. 1 shows an assembly of a heat recovery system according to the disclosure in a top view.

FIG. 1 shows an assembly 10. The assembly 10 may be mounted in a motor vehicle which is not illustrated for the sake of simplicity.

The assembly 10 includes an exhaust gas-carrying pipe 12, through which exhaust gases can flow from an internal combustion engine to an exhaust.

An exhaust gas recirculation component 14 via which exhaust gas can be recirculated into an intake chamber branches off from the exhaust gas-carrying pipe 12.

Furthermore, the assembly 10 has a heat exchanger 16 in which heat can be transferred from the exhaust gas flowing through the exhaust gas-carrying pipe 12 to a heat-transfer medium, hereinafter referred to as a coolant.

To this end, the heat exchanger 16 includes a coolant jacket 18 having a coolant inlet 20 and a coolant outlet 22.

An adjustable element 24 which serves to control the exhaust gas flow through the exhaust gas-carrying pipe 12 is arranged in the exhaust gas-carrying pipe 12. The adjustable element 24 is a flap, for example.

Figure 2:
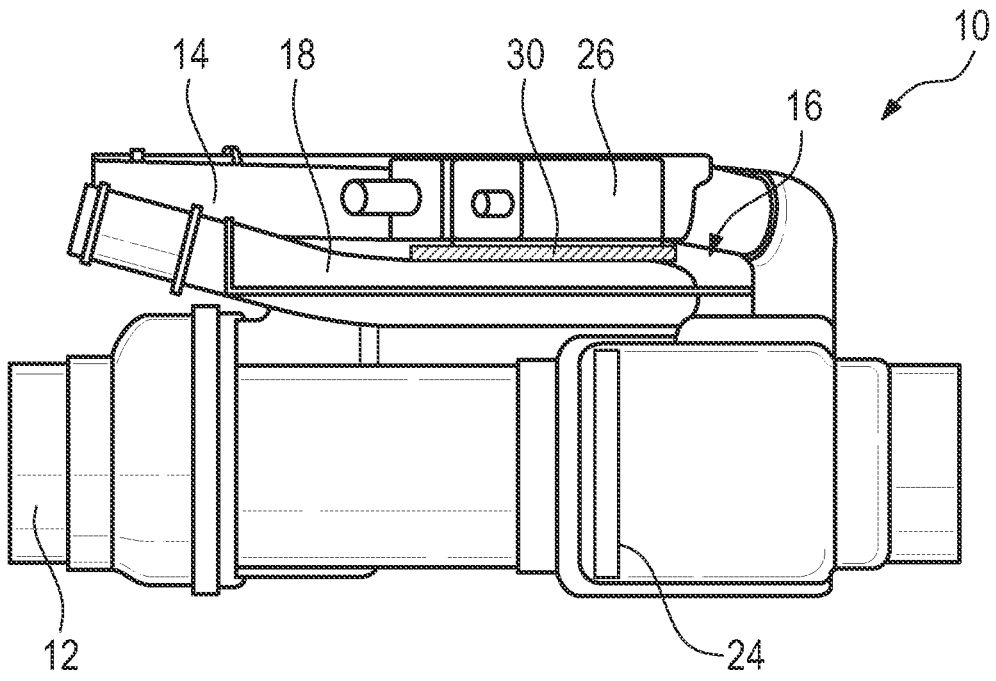
FIG. 2 shows the assembly of FIG. 1 in a side view.

The adjustable element 24 is not visible in the figures, the position of the adjustable element 24 in the exhaust gas-carrying tube is however schematically drawn in FIG. 2.

An actuator 26 is present for adjusting the adjustable element 24.

The actuator 26 is connected to the adjustable element 24 via a rotatably mounted shank 28. The shank 28 may be formed integrally with the adjustable element 24.

Figure 3:
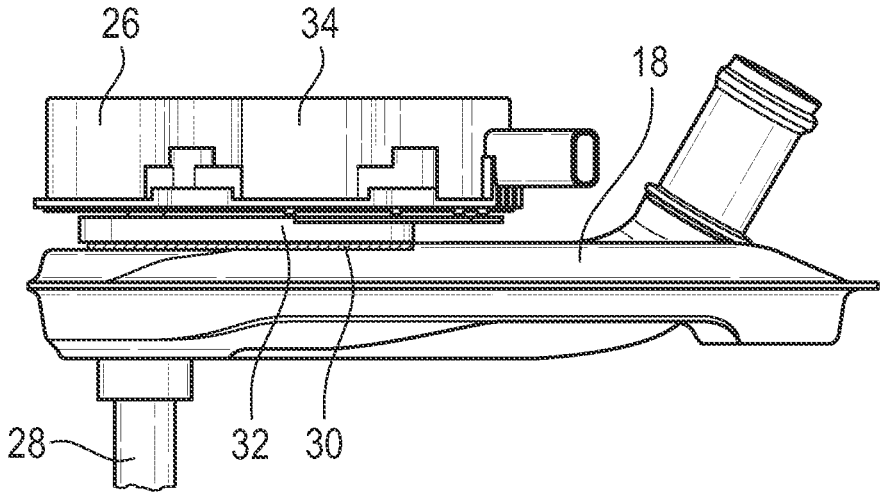
FIG. 3 shows part of a further assembly according to the disclosure.

The position of the shank 28 is shown in FIG. 3. Though the latter shows a different embodiment than FIGS. 1 and 2, the shank 28 is arranged in an identical manner in the different embodiments.

As shown in FIG. 3, the shank 28 extends through the coolant jacket 18. A sealing may be present where the shank 28 enters the coolant jacket 18 or exits the coolant jacket 18 to seal the coolant jacket 18.

The actuator 26 is connected in a planar manner to the coolant jacket 18 via a connecting surface 30. The connecting surface 30 does not necessarily have to be provided on the coolant jacket 18, it is also conceivable that the actuator 26 is connected to another part of the vehicle structure.

A housing 34 of the actuator 26 rests directly against the connecting surface 30 and is connected thereto by an intermaterial bond, in particular soldered or glued. Within the meaning of the present application, the term direct contact is also used when there is a small distance between the actuator 26 and the connecting surface 30 due to an adhesive or solder layer. Such an adhesive layer or solder layer is shown schematically in FIG. 2.

The adhesive or solder can be applied over the entire surface. Alternatively, a large number of individual, separate adhesive dots or solder dots can be distributed evenly over the connecting surface 30 at a small distance from each other.

The connecting surface 30 is preferably configured to be flat. However, more complex, for example single or multiple curved or stepped connecting surfaces 30 are also conceivable.

The connecting surface 30 may be configured to be continuous or interrupted. That is, there may be two connecting surfaces 30 separate from each other.

In the embodiment shown in FIG. 3, an intermediate plate 32 is arranged between the coolant jacket 18 and the actuator 26.

The intermediate plate 32 has a lower side which rests directly against the coolant jacket 18, more specifically against the connecting surface 30, and an upper side which rests against the housing 34 of the actuator 26.

The intermediate plate 32 can be stepped as shown, such that the upper side against which the actuator 26 rests is larger than the lower side which rests against the connecting surface 30. In this way, the largest possible contact surface can be provided for the actuator 26 even if the connecting surface 30 is limited due to installation space conditions.

The intermediate plate 32 is, for example, connected to the connecting surface 30 by an intermaterial bond, in particular glued or soldered. The entire lower side of the intermediate plate 32 may be covered with adhesive or solder.

The actuator 26 may also be glued or soldered to the intermediate plate 32.

Figure 4:
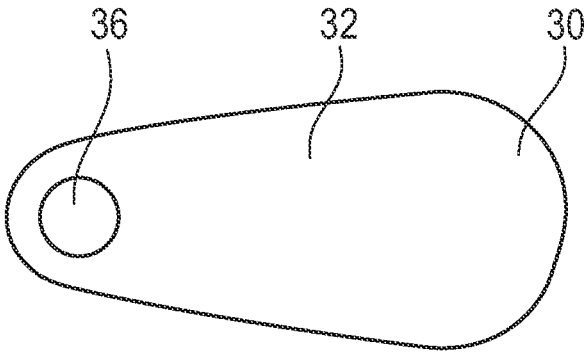
FIG. 4 shows a top view of an intermediate plate of the assembly of FIG. 3.

For example, a recess 36 is provided in the connecting surface 30, in particular in the region where the shank 28 extends through the coolant jacket 18. The recess 36 can be seen in FIG. 4, which shows a top view of the intermediate plate 32.

A recess is also provided in the intermediate plate 32 in the region of the shank 28.

Figure 5:
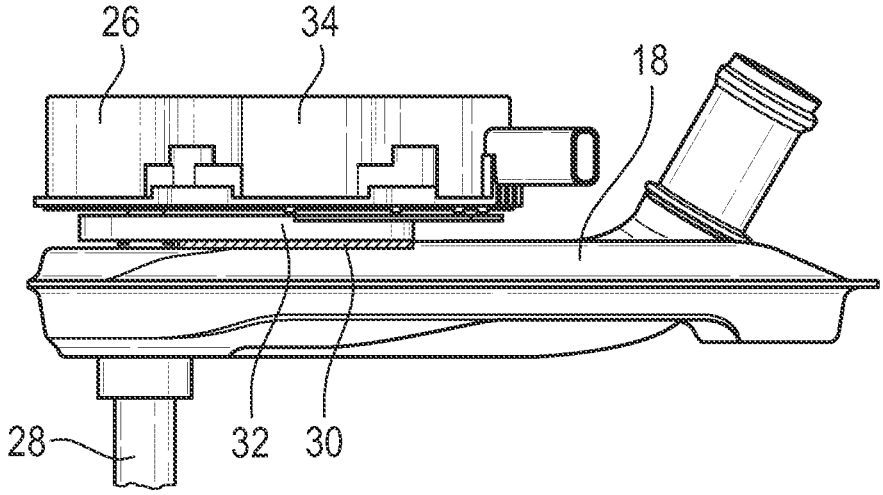
FIG. 5 shows part of yet another assembly according to the disclosure.

In a further embodiment shown in FIG. 5, the connecting surface 30 may be of smaller design than in the embodiment shown in FIG. 3, such that no gluing or soldering is provided in a region around the shank 28. That is, the lower side of the intermediate plate 32 is only partially covered with adhesive or solder.

Figure 6:
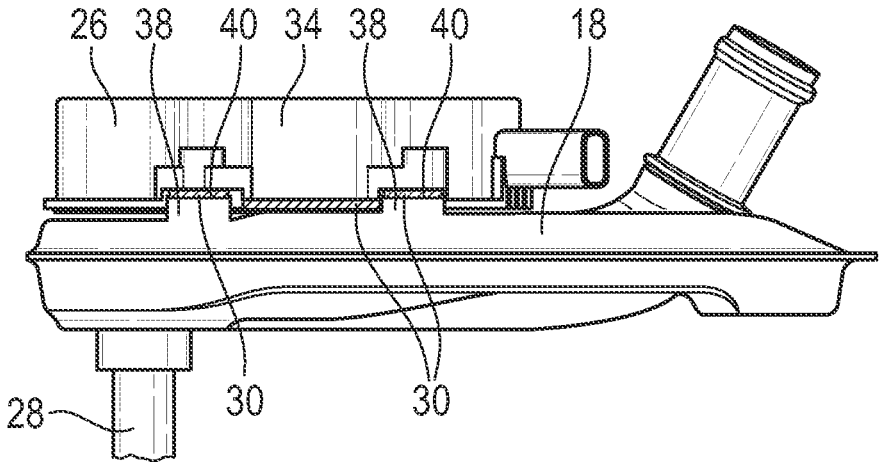
FIG. 6 shows part of yet another assembly according to the disclosure.

FIG. 6 shows a further embodiment. According to FIG. 6, the connecting surface 30 does not run in one plane, but on different planes. In particular, the vehicle structure, in the example embodiment the coolant jacket 18, has a plurality of projections 38 extending towards the actuator 26. The connecting surface 30 extends, on the one hand, along the end faces 40 of the projections 38 and, on the other hand, on a surface offset from the end faces 40.

In a further embodiment, the connecting surface 30 may extend over all side surfaces of a respective projection 38.

Although various embodiments have been disclosed, a worker of ordinary skill in this art would recognize that certain modifications would come within the scope of this disclosure. For that reason, the following claims should be studied to determine the true scope and content of this disclosure.

The invention claimed is:

1. An assembly for a motor vehicle, comprising:

an exhaust gas-carrying pipe in which an adjustable element is arranged to control an exhaust gas flow through the exhaust gas-carrying pipe;

an actuator to adjust the adjustable element, wherein the actuator is connected in a planar manner to a vehicle structure via a connecting surface, and wherein a housing of the actuator is directly connected to the connecting surface by an intermaterial bond; and a coolant jacket, a heat exchange being possible between the exhaust gas-carrying pipe and the coolant jacket, and the connecting surface being provided on the coolant jacket.

2. The assembly of claim 1 wherein an intermediate plate is provided, the actuator being fastened to the intermediate plate and the intermediate plate being connected to the connecting surface by an intermaterial bond.

3. The assembly of claim 2 wherein the actuator is connected to the intermediate plate by an intermaterial bond.

4. The assembly of claim 2 wherein the intermediate plate is connected to the connecting surface by the intermaterial bond, which comprises being glued or soldered.

5. The assembly of claim 1 wherein the connecting surface is formed in a continuous manner.

6. The assembly of claim 1 wherein the adjustable element is a flap and the actuator is arranged to drive a rotatably mounted shank connected to the flap.

7. The assembly of claim 6 wherein the rotatably mounted shank extends through the coolant jacket.

8. The assembly of claim 7 wherein a recess is present in the connecting surface in a region in which the rotatably mounted shank extends through the coolant jacket.

9. The assembly of claim 1 wherein an exhaust gas recirculation component branches off from the exhaust gas-carrying pipe downstream of the adjustable element.

10. The assembly of claim 1 wherein the intermaterial bond is glued or soldered.

11. A motor vehicle comprising:

a heat recovery system and/or an exhaust gas recirculation system which comprises an assembly for a motor vehicle; and wherein the assembly includes an exhaust gas-carrying pipe in which an adjustable element is arranged to control an exhaust gas flow through the exhaust gas-carrying pipe, an actuator to adjust the adjustable element, wherein the actuator is connected in a planar manner to a vehicle structure via a connecting surface, and wherein a housing of the actuator is directly connected to the connecting surface by an intermaterial bond, and a coolant jacket, a heat exchange being possible between the exhaust gas-carrying pipe and the coolant jacket, and the connecting surface being provided on the coolant jacket.

12. An assembly for a motor vehicle, comprising:

an exhaust gas-carrying pipe in which an adjustable element is arranged to control an exhaust gas flow through the exhaust gas-carrying pipe;

an actuator to adjust the adjustable element, wherein the actuator is connected in a planar manner to a vehicle structure via a connecting surface; and wherein an intermediate plate is provided, the actuator being fastened to the intermediate plate and the intermediate plate being connected to the connecting surface by an intermaterial bond.

* * * * *